US008511263B2

(12) United States Patent
Ayukawa et al.

(10) Patent No.: US 8,511,263 B2
(45) Date of Patent: Aug. 20, 2013

(54) COOLING-WATER PUMP ARRANGEMENT STRUCTURE OF ENGINE

(75) Inventors: Yuichi Ayukawa, Hiroshima (JP); Ryotaro Nishida, Hiroshima (JP); Toshimasa Kotani, Hiroshima (JP)

(73) Assignee: Mazda Motor Corporation (JP)

( * ) Notice: Subject to any disclaimer, the term of this patent is extended or adjusted under 35 U.S.C. 154(b) by 570 days.

(21) Appl. No.: 12/771,887

(22) Filed: Apr. 30, 2010

(65) Prior Publication Data

US 2010/0313829 A1 Dec. 16, 2010

(30) Foreign Application Priority Data

Jun. 10, 2009 (JP) ..... 2009-139381

(51) Int. Cl.
*F01P 5/10* (2006.01)

(52) U.S. Cl.
USPC ..... 123/41.44; 123/195 R

(58) Field of Classification Search
USPC ..... 123/41.44, 41.33, 41.74, 41.72, 41.79, 123/41.81, 41.83, 41.84, 196 AB; 415/124.2, 415/122.1

IPC ..... F02F 1/14; F01P 3/02
See application file for complete search history.

(56) References Cited

U.S. PATENT DOCUMENTS

| | | | | |
|---|---|---|---|---|
| 3,001,517 | A * | 9/1961 | Baker et al. | 123/41.47 |
| 4,756,280 | A * | 7/1988 | Tamba et al. | 123/41.47 |
| 6,109,221 | A * | 8/2000 | Higgins et al. | 123/41.47 |
| 6,446,585 | B1 * | 9/2002 | Coffey et al. | 123/41.1 |

FOREIGN PATENT DOCUMENTS

| | | |
|---|---|---|
| JP | 07-127520 | 5/1995 |
| JP | 2002-115600 A | 4/2002 |

* cited by examiner

*Primary Examiner* — Noah Kamen
(74) *Attorney, Agent, or Firm* — Studebaker & Brackett PC

(57) ABSTRACT

A pump attaching portion is formed at a specified outside portion of an engine body beside a boss portion of a cylinder-head fastening bolt in such a manner that the pump attaching portion is continuous from the boss portion. The pump attaching portion has an attachment face, which contains a cooling-water introducing port, which is located on the outside of the flange wall and faces toward an engine front side in such a manner that the position of the attachment face is retreated from the flange wall. Accordingly, the sufficient pump-support rigidity can be ensured, restraining the pump attaching portion from projecting greatly toward the side of the engine body.

9 Claims, 6 Drawing Sheets

COOLING-WATER PUMP ARRANGEMENT STRUCTURE OF ENGINE

BACKGROUND OF THE INVENTION

The present invention relates to a cooling-water pump arrangement structure of an engine.

It is generally known that in a multi-cylinder engine which has plural cylinder bores arranged in line, an engine body (cylinder block) and a housing of a cooling-water pump are integrally formed by casting so that the engine body contains a pump chamber of the cooling-water pump in it. Japanese Patent Laid-Open Publication No. 2002-115600, for example, discloses that the pump chamber of the cooling-water pump is formed at a protruding portion which projects toward the engine side from a front wall portion of the engine body.

Meanwhile, it is also known that the cooling-water pump is formed separately from and attached to the engine body. Japanese Patent Laid-Open Publication No. 7-127520 discloses that a pump-attachment face having a cooling-water introducing port formed thereon is formed at a side wall of a front portion of the engine body, and the cooling-water pump is attached to the pump-attachment face in a lateral attaching state.

The above-described integral forming of the engine body and the pump chamber may improve reductions of the number of components or steps of manufacturing process, but since it is necessary that some protruding portion projecting toward the engine side to form the pump chamber is provided at the front wall portion of the engine body, the engine body may inevitably have a partially-projecting irregular shape. This would cause some deterioration in providing smooth and proper casting. For example, these days the engine body has been designed in an open deck structure in which its cylinder outer wall is not connected to upper ends of its cylinder bores, and made by a high-pressure casting promptly. However, if the engine body had such a partially-projecting irregular shape described above, a smooth gas removal (exhaustion) could not be achieved in a cast, so that the casting would be deteriorated.

This matter is applicable not only to a case in which the pump chamber is integrally formed at the above-described protruding portion of the engine body by casting, but to another case in which the pump-attaching face which faces toward the engine front side is formed at the protruding portion and the cooling-water pump is attached to this face from the engine front side by bolts. That is, as the amount of projection toward the engine side for forming the pump-attaching face becomes greater, the degree of irregularity of the partially-projecting irregular shape may increase, so that the casting may be deteriorated.

Meanwhile, in case the pump-attachment face is formed at the side wall of the front portion of the engine body and the cooling-water pump is attached to the pump-attachment face in the lateral attaching state, it is not necessary to provide any protruding portion projecting toward the engine side from the engine body. However, in case some device is driven by an engine crankshaft via a belt, it may be difficult to restrain the belt from producing an improper belt noise (which may be caused by a slippage between the belts and pulleys) in case of the above-described attachment in the lateral attaching state.

Thus, it is necessary to increase a positional accuracy between a pump pulley and a crank pulley in an engine longitudinal direction in order to prevent such an improper belt noise properly. Herein, increasing the positional accuracy may be easier by controlling of forming the pump-attachment face in case of the pump-attaching portion. However, in case of the attachment in the lateral attaching state, increasing the positional accuracy cannot be achieved by the controlling of forming the pump-attachment face, so that it may be necessary that the increase of the positional accuracy in the engine longitudinal direction is achieved by using a positioning pin, for example. This positioning pin, however, is inserted into a hole formed at the side wall of the engine body for fixing, so that some positional gap may be inevitably generated. Accordingly, the positional accuracy between the pump pulley and the crank pulley in the engine longitudinal direction would deteriorate, so that some improper belt noise would occur.

SUMMARY OF THE INVENTION

An object of the present invention is to provide a cooling-water pump arrangement structure of an engine which can improve the above-described issues of the casting deterioration and the positional inaccuracy of the cooling-water pump.

According to the present invention, there is provided a cooling-water pump arrangement structure of an engine, comprising a cooling-water pump provided at a side portion of a front portion of an engine body having plural cylinder bores arranged in line, a pair of flange walls for attaching a front cover, the flange walls projecting toward an engine front side from both sides of a front wall of the engine body, a pump attaching portion for attaching the cooling-water pump, the pump attaching portion formed at a specified outside portion of the engine body which is located at a corner portion of the engine body beside a boss portion of a cylinder-head fastening bolt, the pump attaching portion having an attachment face which is located on the outside of the flange wall and faces toward the engine front side, and a cooling-water introducing port formed on the attachment face of the pump attaching portion and connecting to a cooling-water jacket enclosing the plural cylinder bores, wherein the cooling-water pump is fastened to the pump attaching portion with bolts which are inserted from the engine front side at least at plural positions above and below the cooling-water introducing port.

According to the present invention, since the cooling-water pump is attached to the attachment face of the pump attaching portion which faces toward the engine front side, it can be easier to increase the positional accuracy between the crank pulley and the pump pulley in the engine longitudinal direction by the proper controlling of forming the pump-attachment face. Further, since the pump attaching portion is formed at the specified outside portion of the engine body which is located at the corner portion of the engine body beside the boss portion of the cylinder-head fastening bolt, that is, in such a manner that the pump attaching portion is continuous from the boss portion of the cylinder-head fastening bolt, any load acting on the pump attaching portion which may be caused by the belt drive of the cooling-water pump can be properly dispersed (transmitted) to the boss portion of the engine body which is generally made with a high rigidity. Accordingly, the sufficient pump-support rigidity can be ensured.

Thus, even if the attachment of the cooling-water pump to the pump attaching portion is achieved by the bolt fastening at the plural positions above and below the cooling-water introducing port, the cooling-water pump can be supported at the engine body firmly. This means that it may not be necessary to form the pump attaching portion so as to project greatly toward the engine side from the engine body, so that the above-described casting deterioration can be improved, and also any vibration caused by the belt drive of the cooling-water pump can be suppressed, which can be superior in the belt-noise production. Further, since the attachment face of the pump attaching portion is located on the outside of the flange wall, that is, in such a manner that the position of the attachment face is retreated from the flange wall, bending of the flange wall due to the belt drive of the cooling-water pump can be suppressed, so that the sealing function of the front cover for the engine body can be improved.

According to an embodiment of the present invention, the attachment face of the pump attaching portion has a vertically-elongated shape, when viewed from the engine front side, containing the cooling-water introducing port and bolt holes for the bolts located above and below the cooling-water introducing portion therein. Thereby, the amount of projection of the pump attaching portion toward the engine side from the engine body is properly small, so that the casting deterioration can be prevented.

According to another embodiment of the present invention, the engine body, which has an open deck structure, is made from aluminum alloy by a high-pressure casting. That is, the engine body with the open deck structure may be superior in application of the high-pressure casting. Herein, since the amount of projection of the pump attaching portion toward the engine side can be smaller as described above, the casting deterioration can be prevented and therefore the present invention can be further superior in the application of the high-pressure casting.

According to another embodiment of the present invention, the engine body is installed laterally in an engine room at a front portion of a vehicle laterally with a cylinder line arranged in a vehicle width direction, and at least two devices which are driven by an engine crankshaft via belts like the cooling-water pump are arranged vertically on the other side of the engine body which is opposite to the side where the cooling-water pump is attached. In general, three or more devices including the cooling-water pump may be arranged on the side(s) of the engine body. In this case, it is necessary to arrange these devices properly in order to prevent any improper interference among them, which may not facilitate a compact layout. According to the present embodiment, however, since the cooling-water pump is arranged on one side of the engine body and the other devices are arranged vertically on the other side of the engine body, it can be easier to arrange the devices compactly, restraining any improper projection of those from the engine body.

Other features, aspects, and advantages of the present invention will become apparent from the following description which refers to the accompanying drawings.

DETAILED DESCRIPTION OF THE INVENTION

Hereinafter, a preferred embodiment of the present invention will be described referring to the accompanying drawings. Herein, the preferred embodiment is merely an example of the present invention, and the present invention should not be limited to this embodiment in its application.

Figure 1:
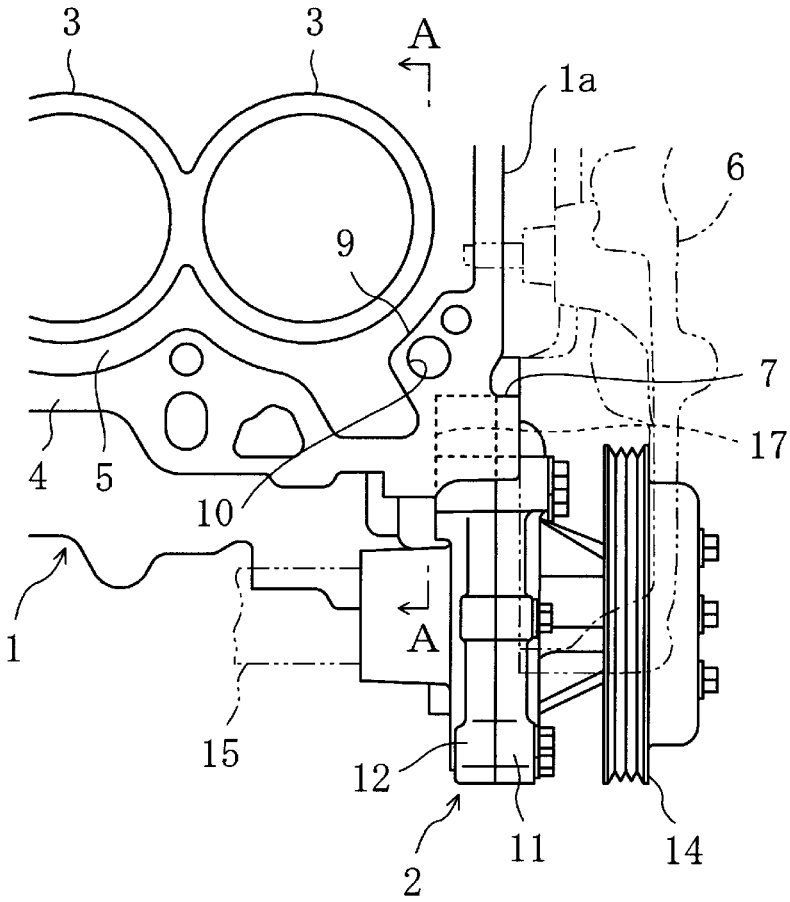
FIG. 1 is a plan view showing a cooling-water pump arrangement structure of an engine according to the present invention.
Figure 3:
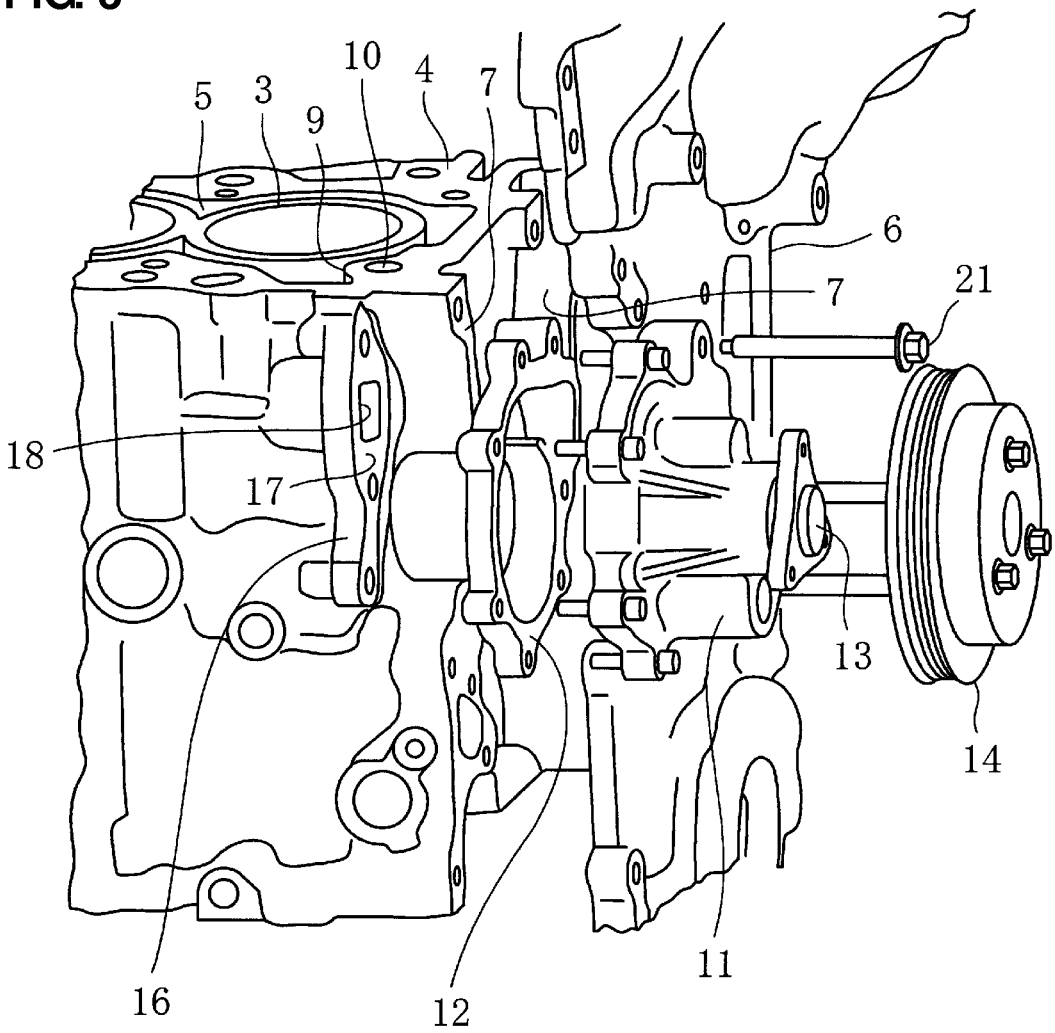
FIG. 3 is an exploded view showing the arrangement structure.

In FIGS. 1 (plan view) and 2 (elevational view), reference numeral 1 denotes an engine body (cylinder block), and reference numeral 2 denotes a cooling-water pump which is provided at a side portion of a front portion of the engine body 1. The engine body 1, as shown in FIG. 3, has plural cylinder bores 3 which are arranged in line and an open deck structure in which its cylinder outer wall 4 is not connected to upper ends of its cylinder bores 3. A cooling-water jacket 5 is formed inside the cylinder outer wall 4 so as to enclose the plural cylinder bores 3. The engine body 1 is made from aluminum alloy by a high-pressure casting.

Figure 4:
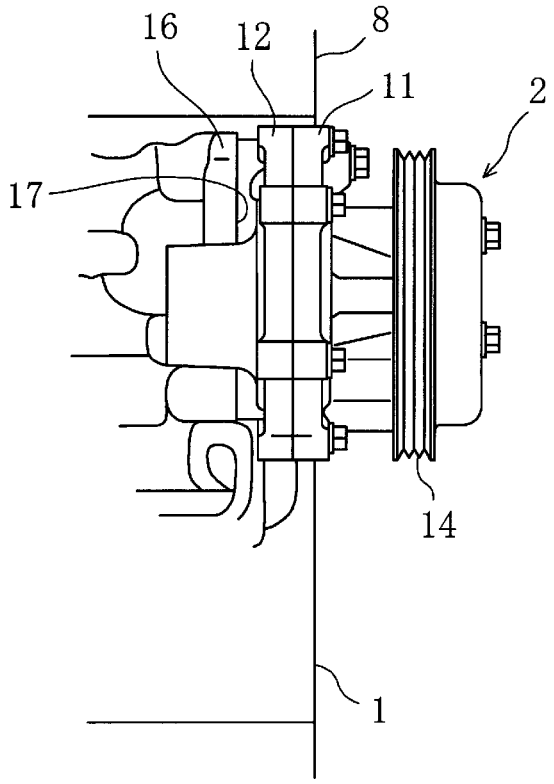
FIG. 4 is a side view showing the arrangement structure.
Figure 7:
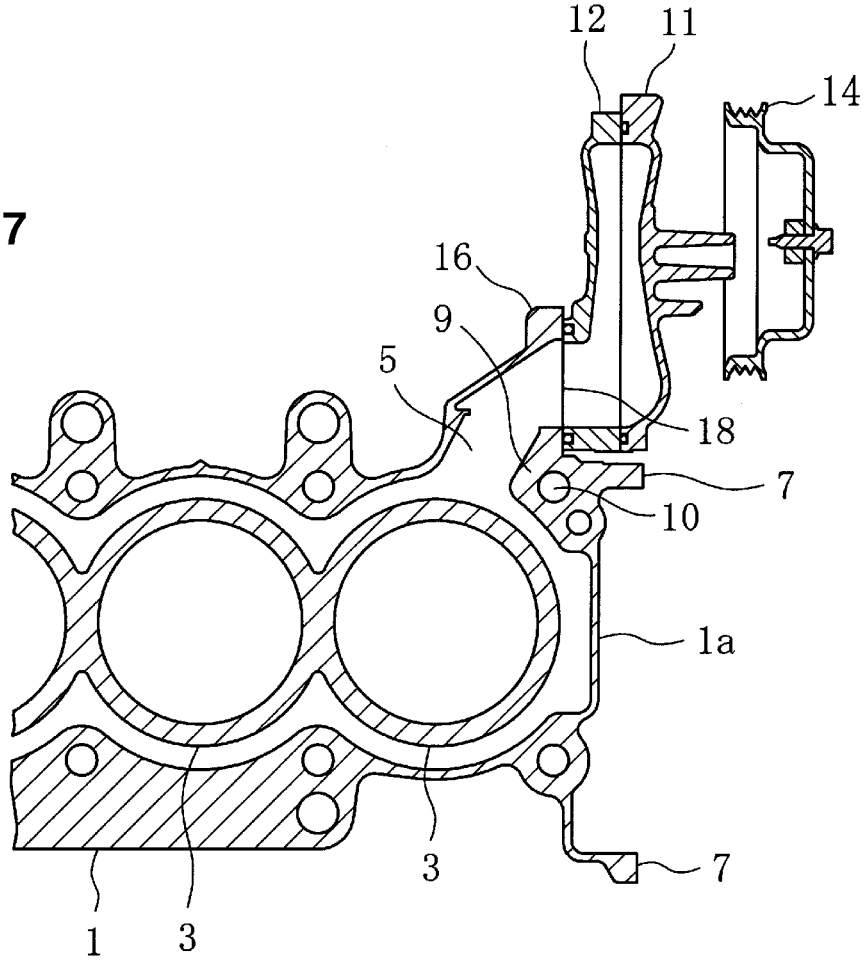
FIG. 7 is a sectional view taken along line B-B of FIG. 2.
Figure 8:
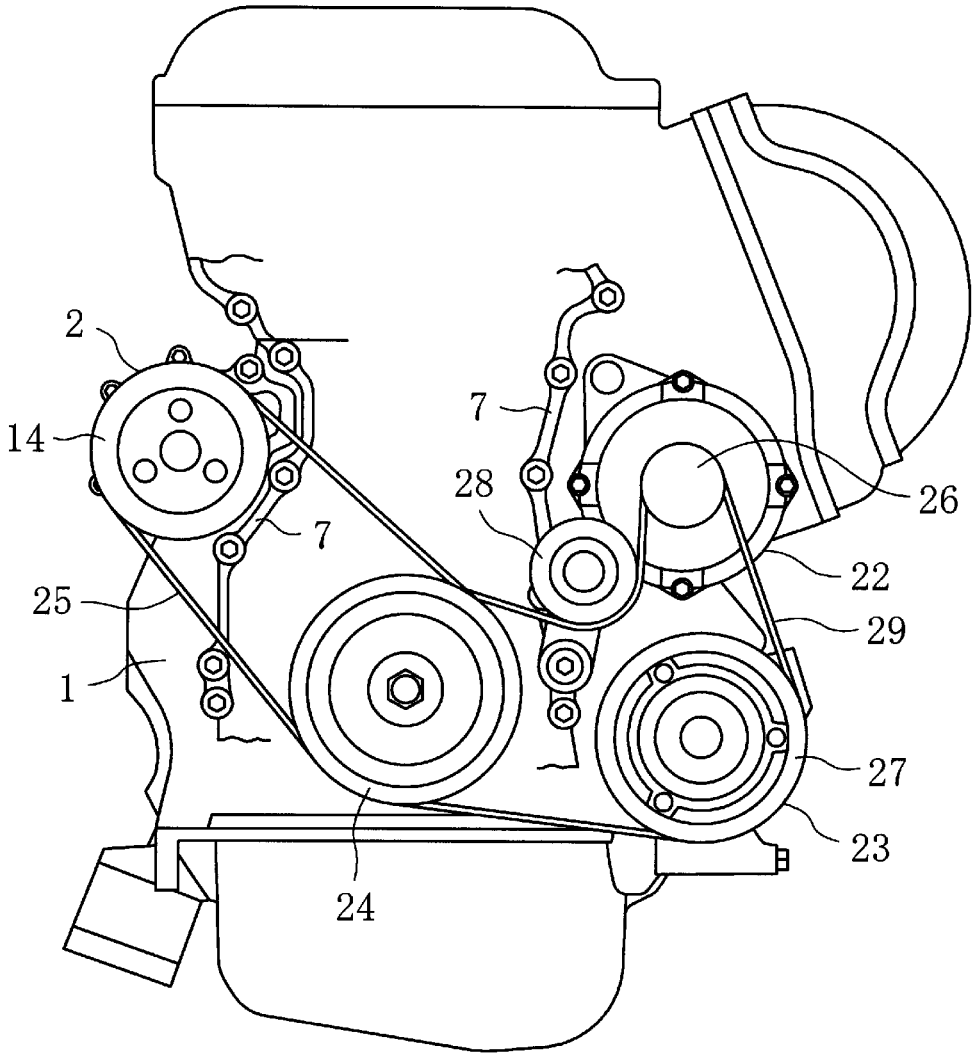
FIG. 8 is an elevational view showing the engine, omitting a part of the engine.

A pair of flange walls 7 for attaching a front cover 6 is provided so as to project toward an engine front side from both sides of a front wall 1*a* of the engine body 1 as shown in FIGS. 7 and 8. As shown in FIG. 4, boss portions 9 of bolts for fastening a cylinder head 8 shown in FIG. 4 are formed at the cylinder outer wall 4, and bolt holes 10 are formed at an upper face (top deck) of the cylinder outer wall 4.

The cooling-water pump 2 comprises a front housing 11 and a rear housing 12 which form a pump chamber together. An impeller is supported at the front housing 11, and a pump pulley 14 is coupled to a drive shaft 13 of the impeller. A cooling-water supply pipe 15 which extends from a radiator is connected to the rear housing 12.

Figure 5:
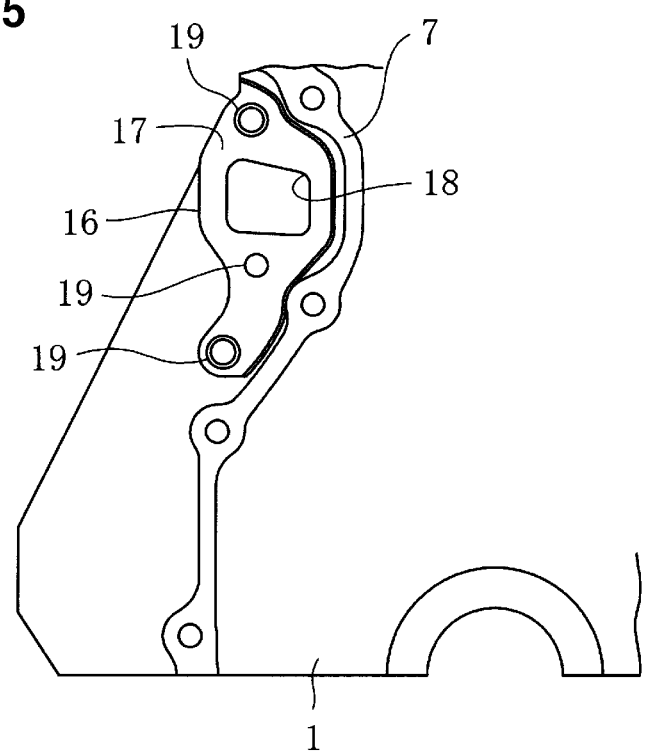
FIG. 5 is an elevational view showing a part of a pump attaching portion of the same arrangement structure.
Figure 6:
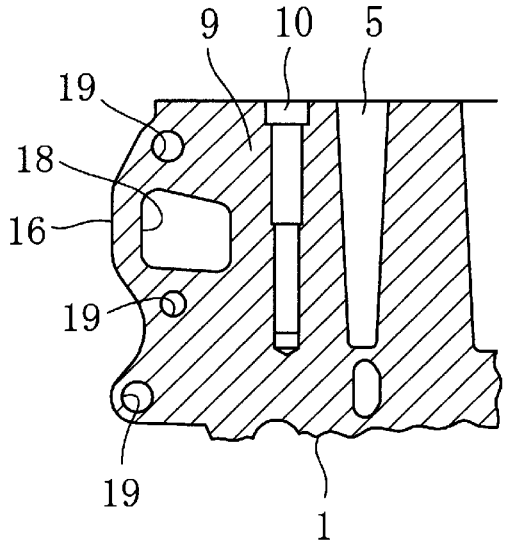
FIG. 6 is a sectional view of an engine body taken along line A-A of FIG. 1.

As shown in FIGS. 3 and 5, a pump attaching portion 16 for attaching the cooling-water pump 2 is formed at an outside portion of the engine body 1 which is located at a corner portion of the engine body 1 beside the boss portion 9. Herein, the pump attaching portion 16 has an attachment face 17 which is located on the outside of the flange wall 7 and faces toward the engine front side. That is, the pump attaching portion 16 is formed so as to project outwardly from the engine body 1 in such a manner that the pump attaching portion 16 is continuous from the boss portion 9 and the position of the attachment face 17 is retreated from the flange wall 7 as shown in FIG. 6.

A cooling-water introducing port 18 which connects to a cooling-water jacket 5 of the engine body 1 and plural bolt holes 19 for attaching the cooling-water pump 2 are formed on the attachment face 17 of the pump attaching portion 16 as shown in FIG. 7. The bolt holes 19 are formed so as to open at one position above the cooling-water introducing port 18 and at two positions below the cooling-water introducing port 18. The attachment face 17 has a vertically-elongated shape, when viewed from the engine front side, containing the above-described cooling-water introducing port 18 and the three bolt holes 19 therein. Herein, all of the bolt hoes 19 are formed at the attachment face 17 of the pump attaching portion 16 at positions which are offset inwardly from an axial center of the cooling-water pump 2 in the engine width direction.

Figure 2:
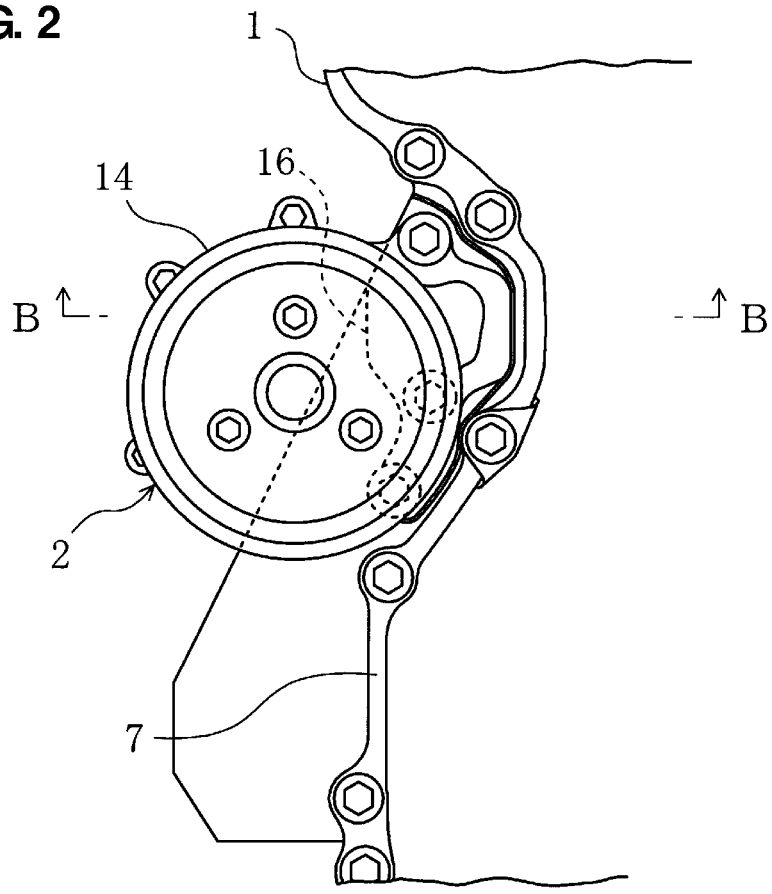
FIG. 2 is an elevational view showing the arrangement structure.

The cooling-water pump 2 is fastened to the pump attaching portion 16 by the fastening bolts 21 which are inserted from the engine-front side into the bolt holes 19 arranged above and below the cooling-water introducing port 18, so that an inward part of the cooling-water pump 2 which is offset from its pump axial center and close to the engine body 1 is attached to the pump attaching portion 16 as shown in FIG. 2. Herein, the upper bolt hole and the lower bolt hole among the three bolt holes 19 have a larger diameter compared to the middle bolt. This is because tube pins (sleeve collars) are inserted into these upper and lower bolt holes 19.

Further, as shown in FIG. 8, an alternator 22 and a compressor for air-conditioning 23 which are driven by the engine crankshaft via belts, like the cooling-water pump 2, are arranged vertically on the other side of the engine body 1 which is opposite to the side where the cooling-water pump 2 is attached. A first drive belt 25 is applied around a crank pulley 24 coupled to the crankshaft and a pump pulley 14, and a second drive belt 29 is applied around the crank pulley 24, a pulley 26 of the alternator 22, a pulley 27 of the compressor 23, and an idler 28.

According to the above-described cooling-water pump arrangement structure of an engine, since the attachment face 17 of the pump attaching portion 16 faces toward the engine front side on the one side of the front portion of the engine body 1, the attachment of the cooling-water pump 2 is the so-called frontal attaching. Accordingly, it can be easier to increase the positional accuracy between the crank pulley 24 and the pump pulley 14 in the engine longitudinal direction (to prevent any occurrence of positional gap) by the appropriate controlling of forming the pump-attachment face 17.

Further, since the pump attaching portion 16 is formed at the specified outside portion of the engine body 1 in such a manner that the pump attaching portion 16 is continuous from the boss portion 9 of the cylinder-head fastening bolt, any load acting on the pump attaching portion 16 which may be caused by the belt drive of the cooling-water pump 2 can be properly dispersed (transmitted) to the boss portion 9 of the engine body 1 which is generally made having a high rigidity. Accordingly, the sufficient pump-support rigidity 16 can be ensured. Thus, despite a situation in which the cooling-water pump 2 is supported at the engine body 1 by using its inward part which is offset from its pump axial center and close to the engine body 1 and also in which the support face (attachment face 17) of the pump attaching portion 16 has the vertically-elongated shape, the cooling-water pump 2 can be supported at the engine body 1 firmly.

Thus, since it can be easier to increase the positional accuracy between the crank pulley 24 and the pump pulley 14 in the engine longitudinal direction and the high pump-support rigidity can be provided, it can be also restrained that the belt produces any improper belt noise. Further, since it may not be necessary to form the pump attaching portion 16 so as to project greatly toward the engine side from the engine body 1 for supporting the cooling-water pump 2, it can be avoided that the engine body 1 has a partially-projecting irregular shape, so that any casting deterioration in the high-pressure casting can be properly avoided. Further, since the attachment face 17 of the pump attaching portion 16 is located on the outside of the flange wall 7 in such a manner that the position of the attachment face 17 is retreated from the flange wall 7, any bending of the flange wall 7 due to the belt drive of the cooling-water pump 2 can be suppressed, so that the sealing function of the front cover 6 for the engine body 1 can be improved.

Moreover, according to the above-described embodiment, since the cooling-water pump 2 is arranged on one side of the engine body 1 and the alternator 22 and the air-conditioning compressor 23 are arranged vertically on the other side of the engine body 1, these devices can be restrained from projecting greatly toward the engine side from the engine body 1, so that the engine can be made properly compact as a whole.

The present invention should not be limited to the above-descried embodiment, and any other modifications or improvements may be applied within the scope of a sprit of the present invention.

What is claimed is:

1. A cooling-water pump arrangement structure of an engine, comprising:

a cooling-water pump provided at a side portion of a front portion of an engine body having plural cylinder bores arranged in line, the cooling-water pump including a pump pulley which is driven by a crank pulley of the engine via a belt;

a pair of flange walls for attaching a front cover, the flange walls projecting toward an engine front side from both sides of a front wall of the engine body;

a pump attaching portion for attaching the cooling-water pump, the pump attaching portion being integrally formed at a specified outside portion of the engine body which is located at a corner portion of the engine body beside a boss portion of a cylinder-head fastening bolt so as to project outwardly from the engine body and be continuous from the boss portion, the pump attaching portion having an attachment face which is located on the outside of said flange wall and of a vertically-elongated shape, when viewed from the engine front side, and faces toward the engine front side, a position of the attachment face being retreated toward an engine rear side from said flange wall; and a cooling-water introducing port formed on the attachment face of said pump attaching portion and connecting to a cooling-water jacket enclosing the plural cylinder bores, wherein the cooling-water pump is fastened to the attaching face of said pump attaching portion with a plurality of bolts which are inserted from the engine front side such that bolt holes of the plural bolts are located above and below said cooling-water introducing port in the attaching face of the pump attaching portion.

2. The cooling-water pump arrangement structure of an engine of claim 1, wherein said bolt holes for the plurality of bolts are formed at said attachment face of the pump attaching portion at a position which is offset inwardly from an axial center of the cooling-water pump in an engine width direction such that the cooling-water pump is supported at the pump attaching portion via an inward-side part thereof.

3. The cooling-water pump arrangement structure of an engine of claim 2, wherein said engine body, which has an open deck structure, is made from aluminum alloy by a high-pressure casting.

4. The cooling-water pump arrangement structure of an engine of claim 2, wherein said engine body is installed laterally in an engine room at a front portion of a vehicle laterally with a cylinder line arranged in a vehicle width direction, and at least two devices which are driven by an engine crankshaft via belts like the cooling-water pump are arranged vertically on the other side of the engine body which is opposite to the side where the cooling-water pump is attached.

5. The cooling-water pump arrangement structure of an engine of claim 1, wherein said engine body, which has an open deck structure, is made from aluminum alloy by a high-pressure casting.

6. The cooling-water pump arrangement structure of an engine of claim 5, wherein said engine body is installed laterally in an engine room at a front portion of a vehicle laterally with a cylinder line arranged in a vehicle width direction, and at least two devices which are driven by an engine crankshaft via belts like the cooling-water pump are arranged vertically on the other side of the engine body which is opposite to the side where the cooling-water pump is attached.

7. The cooling-water pump arrangement structure of an engine of claim 1, wherein said engine body is installed laterally in an engine room at a front portion of a vehicle laterally with a cylinder line arranged in a vehicle width direction, and at least two devices which are driven by an engine crankshaft via belts like the cooling-water pump are arranged vertically on the other side of the engine body which is opposite to the side where the cooling-water pump is attached.

8. A cooling-water pump arrangement structure of an engine, comprising:

a cooling-water pump provided at a side portion of a front portion of an engine body having plural cylinder bores arranged in line, the cooling-water pump including a pump pulley which is driven by a crank pulley of the engine via a belt;

a pair of flange walls for attaching a front cover, the flange walls projecting toward an engine front side from both sides of a front wall of the engine body;

a pump attaching portion for attaching the cooling-water pump, the pump attaching portion being integrally formed at a specified outside portion of the engine body which is located at a corner portion of the engine body beside a boss portion of a cylinder-head fastening bolt so as to project outwardly from the engine body and be continuous from the boss portion, the pump attaching portion having an attachment face which is located on the outside of said flange wall and of a vertically-elongated shape, when viewed from the engine front side, and faces toward the engine front side, a position of the attachment face being retreated rearward from the flange wall; and a cooling-water introducing port formed on the attachment face of said pump attaching portion and connecting to a cooling-water jacket enclosing the plural cylinder bores, wherein the cooling-water pump is fastened to the attaching face of said pump attaching portion with a plurality of bolts which are inserted from the engine front side such that bolt holes for the plurality of bolts are located above and below said cooling-water introducing port in the attaching face of the pump attaching portion, said bolt holes of the plurality of bolts are formed at said attachment face of the pump attaching portion at a position which is offset inwardly from an axial center of the cooling-water pump in an engine width direction such that the cooling-water pump is supported at the pump attaching portion via an inward-side part thereof, and said engine body, which has an open deck structure, is made from aluminum alloy by a high-pressure casting.

9. A cooling-water pump arrangement structure of an engine, comprising:

a cooling-water pump provided at a side portion of a front portion of an engine body having plural cylinder bores arranged in line, the cooling-water pump including a pump pulley which is driven by a crank pulley of the engine via a belt;

a pair of flange walls for attaching a front cover, the flange walls projecting toward an engine front side from both sides of a front wall of the engine body;

a pump attaching portion for attaching the cooling-water pump, the pump attaching portion being integrally formed at a specified outside portion of the engine body which is located at a corner portion of the engine body beside a boss portion of a cylinder-head fastening bolt so as to project outwardly from the engine body and be continuous from the boss portion, the pump attaching portion having an attachment face which is located on the outside of said flange wall and of a vertically-elongated shape, when viewed from the engine front side, and faces toward the engine front side, a position of the attachment face being retreated rearward from the flange wall; and a cooling-water introducing port formed on the attachment face of said pump attaching portion and connecting to a cooling-water jacket enclosing the plural cylinder bores, wherein the cooling-water pump is fastened to the attaching face of said pump attaching portion with a plurality of bolts which are inserted from the engine front side such that bolt holes for the plurality of bolts are located above and below said cooling-water introducing port in the attaching face of the pump attaching portion, said engine body, which has an open deck structure, is made from aluminum alloy by a high-pressure casting, and said engine body is installed laterally in an engine room at a front portion of a vehicle laterally with a cylinder line arranged in a vehicle width direction, and at least two devices which are driven by an engine crankshaft via belts like the cooling-water pump are arranged vertically on the other side of the engine body which is opposite to the side where the cooling-water pump is attached.

* * * * *